US008246346B2

(12) United States Patent
Walters

(10) Patent No.: US 8,246,346 B2
(45) Date of Patent: Aug. 21, 2012

(54) BLOOMING CANDLE

(76) Inventor: Kim Jeffrey Walters, Mill Creek, WA (US)

( * ) Notice: Subject to any disclaimer, the term of this patent is extended or adjusted under 35 U.S.C. 154(b) by 170 days.

(21) Appl. No.: 12/202,051

(22) Filed: Aug. 29, 2008

(65) Prior Publication Data

US 2010/0055631 A1 Mar. 4, 2010

(51) Int. Cl.
*F24D 3/16* (2006.01)

(52) U.S. Cl. ..... 431/288; 431/289; 431/126

(58) Field of Classification Search ..... 431/288, 431/289, 126; D26/6
See application file for complete search history.

(56) References Cited

U.S. PATENT DOCUMENTS

| | | | | |
|---|---|---|---|---|
| 1,195,657 | A * | 8/1916 | Chersky | 431/294 |
| D56,441 | S | 10/1920 | Larkin | |
| 1,622,347 | A | 3/1927 | Rhoads | |
| 2,234,903 | A * | 3/1941 | Muench | 431/125 |
| D130,738 | S | 12/1941 | Balk | |
| D147,730 | S | 10/1947 | Hussey | |
| D170,027 | S | 7/1953 | Perlmutter | |
| 2,974,509 | A * | 3/1961 | Penke | 431/125 |
| 5,069,617 | A * | 12/1991 | Lin | 431/253 |
| D369,871 | S | 5/1996 | Lui | |
| D394,513 | S | 5/1998 | Davis | D26/6 |
| D409,316 | S | 5/1999 | Majerowski | |
| 5,910,005 | A | 6/1999 | Scherr | |
| D456,535 | S | 4/2002 | Yin | |
| D456,536 | S | 4/2002 | Araujo | |
| 6,409,501 | B1 | 6/2002 | Pappas | 431/289 |
| D466,632 | S | 12/2002 | Lablaine | |
| D466,633 | S | 12/2002 | Bennetts et al. | |
| 6,511,313 | B1 | 1/2003 | Livne et al. | |
| 6,699,034 | B2 * | 3/2004 | Schoeck | 431/288 |

(Continued)

FOREIGN PATENT DOCUMENTS

GB 2 196 017 A 4/1988

(Continued)

OTHER PUBLICATIONS

Unpublished U.S. Appl. No. 29/340,412, filed Jul. 17, 2009, by the present Applicant.

(Continued)

*Primary Examiner* — Steven B McAllister
*Assistant Examiner* — Sarah Suereth
(74) *Attorney, Agent, or Firm* — Merchant & Gould P.C.

(57) ABSTRACT

A blooming candle is described as an ornamental candle that transforms between different appearances as the candle burns. The candle has a tapered body that extends along a longitudinal axis from a top portion to a bottom portion, where the top portion has a larger diameter than the bottom portion. Vertical grooves are cut into the outside surface of the tapered body to form segments. When the candle is burned, the center portion of the candle about the wick melts according to the candles defined heat radius. As the candle continues to burn, the wax material begins to soften and the segments between the vertical grooves will begin to separate away from the tapered body. As melting continues, the segments continue to separate in an outward and downward direction, resembling petals from a blooming flower. The described candle structures have a predictable ornamental change in shape during the burning process.

31 Claims, 8 Drawing Sheets

A-A

U.S. PATENT DOCUMENTS

| | | | | |
|---|---|---|---|---|
| 6,733,280 | B1 * | 5/2004 | Livne et al. | 431/288 |
| D496,473 | S | 9/2004 | D'Onofrio | |
| 7,073,497 | B2 | 7/2006 | Dennis et al. | 126/295 |
| 7,144,246 | B2 | 12/2006 | Barnstead | 431/126 |
| 7,187,318 | B1 | 3/2007 | Lee et al. | 341/161 |
| D542,428 | S | 5/2007 | Wagenknecht et al. | |
| 2006/0263733 | A1 | 11/2006 | Furner et al. | 431/292 |
| 2007/0026352 | A1 | 2/2007 | Kubicek et al. | 431/289 |

FOREIGN PATENT DOCUMENTS

| | | |
|---|---|---|
| GB | 2045028 | 6/1995 |
| GB | 2098630 | 4/2001 |

OTHER PUBLICATIONS

Still Image from You Tube—Part 1 (http://www.youtube.com/watch?v=xAfYLyBH6p8 Aug. 21, 2007—User: zhu1188 Snapshots).

Still Image from You Tube—Part 2 (http://www.youtube.com/watch?v=xAfYLyBH6p8 Aug. 21, 2007—User: zhu1188 Snapshots).

Still Image from You Tube—Part 3 (http://www.youtube.com/watch?v=xAfYLyBH6p8 Aug. 21, 2007—User: zhu1188 Snapshots).

* cited by examiner

A-A

A-A

BLOOMING CANDLE

FIELD OF THE INVENTION

The present disclosure generally relates to an ornamental candle including a careful arrangement of geometric shapes. More particularly, the described candles each include a set of carefully arranged geometric shapes that are arranged to control changes in the shape of the candle during the burning process. The described changes in the shape of the candle correspond to a movement of outer surface segments in an outward and downward direction that simulates the opening up or blooming of a large flower.

BACKGROUND OF THE INVENTION

Throughout time the basic candle has been used to give light. Over time it has been altered with color and fragrance to make it ornamental and decorative in addition to providing illumination. Candles have taken on various shapes and images which include miniature statues of buildings, animals, people and basic geometric shapes. Such conventional candles each have something in common, once the candle wick is lit, the burning wick melts the surrounding wax around the flame and deforms the original shape of the candle into a disfigured mass of wax.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

The present disclosure now will be described more fully hereinafter with reference to the accompanying drawings, which form a part hereof, and which show, by way of illustration, specific exemplary embodiments for practicing the invention. This disclosure may, however, be embodied in many different forms and should not be construed as limited to the embodiments set forth herein; rather, these embodiments are provided so that this disclosure will be thorough and complete, and will fully convey the scope to those skilled in the art. Among other things, the present disclosure may be embodied as methods or devices. Accordingly, the present disclosure may take the form of an entirely hardware embodiment, an entirely software embodiment or an embodiment combining software and hardware aspects. The following detailed description is, therefore, not to be taken in a limiting sense.

Briefly stated, the present disclosure generally relates to an ornamental candle referred to as a "blooming candle". The blooming candle is an ornamental candle that transforms between different appearances as the candle burns. The candle has a tapered body that extends along a longitudinal axis from a top portion to a bottom portion, where the top portion has a larger diameter than the bottom portion. Vertical grooves are cut into the outside surface of the tapered body to form segments. When the candle is burned, the center portion of the candle about the wick melts according to the candles defined heat radius. As the candle continues to burn, the wax material begins to soften and the segments between the vertical grooves will begin to separate away from the tapered body. As melting continues, the segments continue to separate in an outward and downward direction, resembling petals from a blooming flower. The described candle structures have a predictable ornamental change in shape during the burning process.

Figure 1:
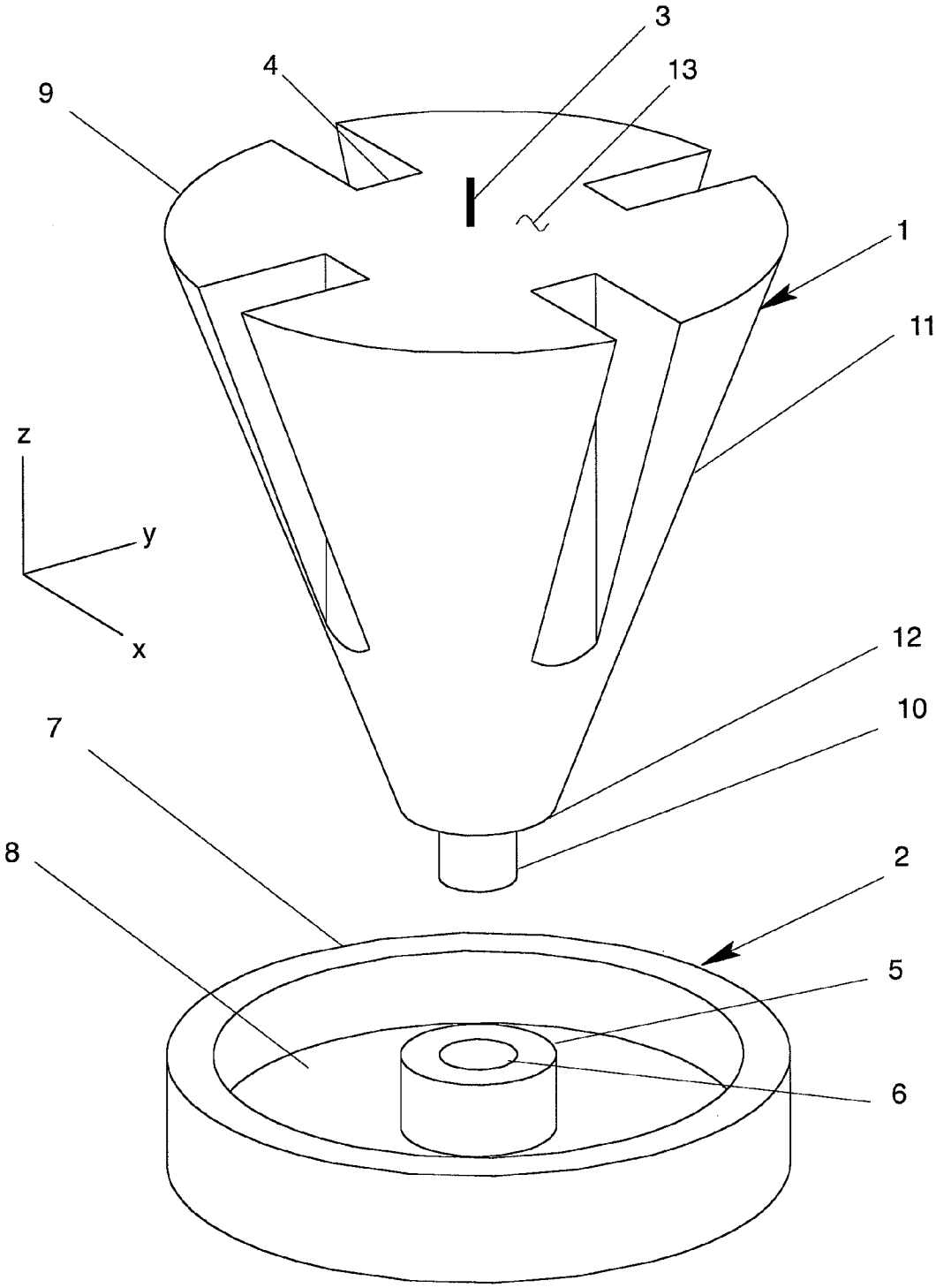
FIG. 1 shows an exploded trimetric view of a candle apparatus including a candle body and a candle base.

FIG. 1 shows an exploded trimetric view of a candle apparatus that includes a candle body (1) and a candle base (2). The body of the candle (1) is arranged orthogonally with respect to the base of the candle (2). For example, a length of the candle body (1) extends along a longitudinal axis (z), while the candle body (2) extends along the surface of a plane (x, y). The longitudinal axis (z) and the surface of the plane (x, y) form an orthogonal set with respect to one another. The candle base (2) is arranged to hold and support the candle body (1) in a substantially vertical orientation along the longitudinal axis (z) when the candle base (2) is placed upon a substantially flat surface in the plane (x, y).

The candle apparatus includes a wick (3) that extends along the longitudinal axis (z) through a substantial portion of the candle body (1). The candle body (1) illustrated in FIG. 1 also extends along the longitudinal axis (z), which includes a wax material extending from a bottom end (12), to a top end (13) that is opposite the bottom end along the longitudinal axis (z).

An example candle base (2) may include all portions of the candle body (1) that are located below the opening of the hole (6) shown in FIG. 1. An outer wall (7) is illustrated that extends from a bottom of candle base (2) and extends upwards along the longitudinal axis (z). An inner wall (5) is also illustrated that is concentrically formed with respect to the outer wall (7), where an interior of the inner wall (5) forms an opening for a hole (6) that mates with the peg (10) at the bottom end (12) of the candle body (1).

The interlocking arrangement of the hole (6) and the peg (10) can be configured to provide vertical stability for the candle body (1). A void (8) or trough region can also be formed in the candle base (2) between the outer wall (7) and the inner wall (5) such that liquefied wax material that is produced during the melting process is contained to prevent spilling outside of the outer wall (7). Variations on the candle base (2) can be seen in FIG. 6 and FIG. 7, but are not limited to these configurations. Although the surface of the outer wall (7) and the inner wall (5) are illustrated as substantially vertical walls with a trough region (8) formed there between, the outer wall (7) and the inner wall (5) walls can have a different cross-sectional profile that results in other non-vertical configurations including but not limited to sloped walls that can be linearly sloped, non-linearly sloped, piece-wise linearly sloped, piece-wise non-linearly sloped, or any reasonable combination thereof.

In some examples the candle base (2) may be integrally formed with the candle body (1). In other examples, the candle base (2) can be formed as a separate piece from the candle body (1), which may later be joined by an interlocking member (e.g., a hole in the base and a peg in the candle, or vice-versa) at an interface between the candle base (2) and the candle body (1). For the example illustrated in FIG. 1, the bottom end (12) of the candle body (1) includes a male interface element corresponding to a peg (10) that is arranged to mate with a female interface element corresponding to a hole (6) in the candle base (2). Although the interlocking members illustrated in FIG. 1 correspond to a peg and a hole, any other interlocking members can be utilized without departing from the spirit of the present disclosure. In other examples, an oval peg or an n-sided peg (where n is an integer greater than two) and corresponding mating element may be used. Example n-sided pegs include a 3-sided (triangular), a 4-sided (square or rectangular), a 5-sided (pentagonal) or a 6-sided (hexagonal) arrangement.

Figure 6:
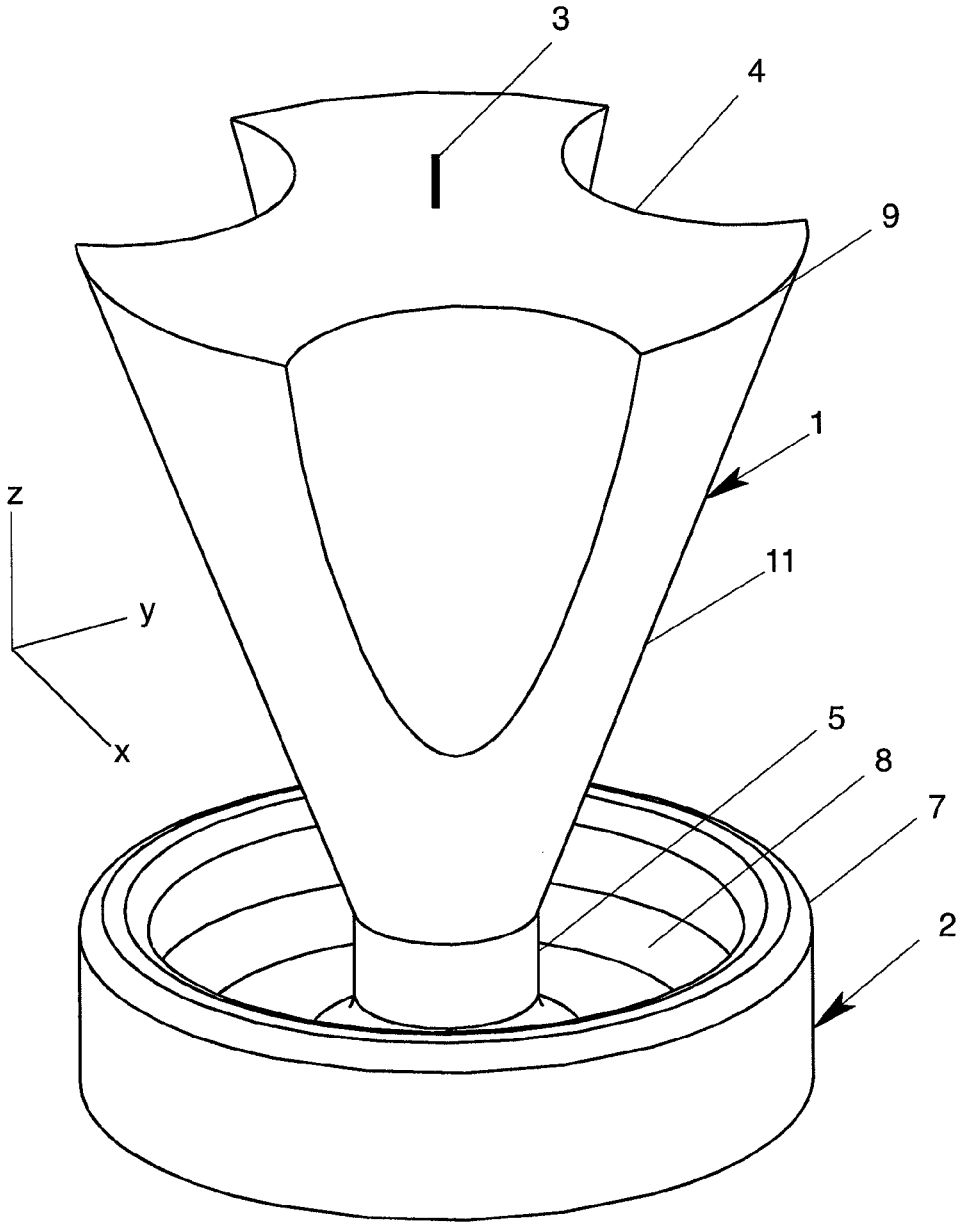
FIG. 6 is a trimetric view of a candle configuration that has three large semicircle vertical grooves.
Figure 7:
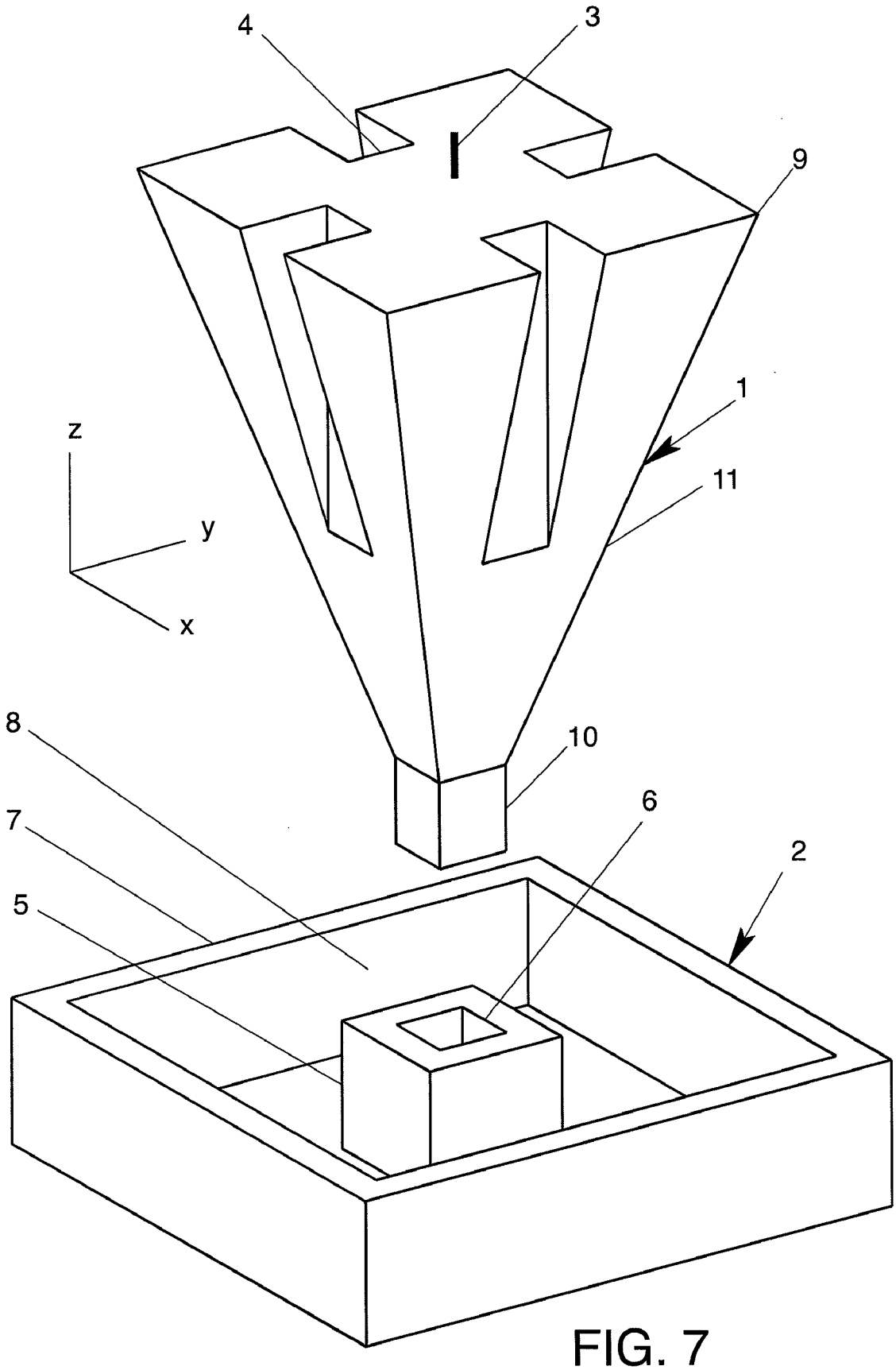
FIG. 7 is a trimetric view of a candle configuration that is square on top and gets smaller towards the base.

FIG. 1 further illustrates that long vertical grooves (4) extend through a portion of the outside surface of the candle body (1) extending along the direction of the longitudinal axis (z). The grooves (4) can vary in shape from a simple slot to a large radius or any other shape that can break the outside surface of the candle body (1) into segments with deep cuts (ref. FIG. 6 for another example groove 4). Although the minimum number of grooves (4) is two, any other number of grooves can also be utilized.

As illustrated by the examples of FIG. 1 and FIG. 6, the shape of the grooved portions can be in any variety of shapes that are generally vertically oriented (i.e., extending along the longitudinal axis of the outer surface of the candle body to form segments). In some simple configurations a straight line groove can be utilized with a uniform width for the groove (e.g., see FIG. 1). In some other configurations, a varying width groove can be utilized (e.g., See FIG. 6). As illustrated in the figures, the depth of the groove can vary along with length of the candle body such that the groove depth near the top of the candle can be larger than the groove depth near the bottom of the candle. Also illustrated in the figures, the depth of the groove can vary along the width of the candle body. For example, the depth of the groove at a horizontal cross-section for the candle in FIG. 1 is uniform in depth, while the depth of the groove at a horizontal cross-section for the candle in FIG. 6 has a non-linearly varying depth (although any other varying depth will also work such as linearly varying, piece-wise linearly varying, piece-wise non-linearly varying, etc.). In some other examples, the shape of the grooves can be any combination of a linear shape, a curved shape, a non-linear shape, a piece-wise linear shape, a piece-wise non-linear shape, a zig-zag shape, an S-shaped groove, or any other reasonable combination thereof.

The segments along the outside surface between the vertical grooves (4) can be referred to as petals (9). By increasing the number of grooves (4) in the length of the candle, the number of petals (9) is also increased. When the candle is burning, the wax in the candle will begin to melt and each petal (9) will begin to peel away from the inner core of the candle in an outward direction (e.g., away from the inner core of the candle) as the melting of the candle proceeds downward along the longitudinal axis (z).

In a conventional candle, the length of the candle is typically a cylindrical shape that extends along a single axis so that all of the wax drips along an outer surface of the cylinder. In contrast, the presently described candle apparatus includes a tapered outer surface (11) on the candle body (1) such that the top end portion (i.e., the burning end) of the candle has a larger surface area (e.g., a larger diameter for the top surface (13) for the example of FIG. 1) than the bottom end (i.e., the portion that is held by the base) of the candle. The overall shape of the extending portion of the candle can thus be viewed as a tapered shaft as illustrated. The grooves (4) that are formed along the tapered shaft are arranged to facilitate the separation of the petals (9) from the interior portion of the candle when burning.

Figure 8:
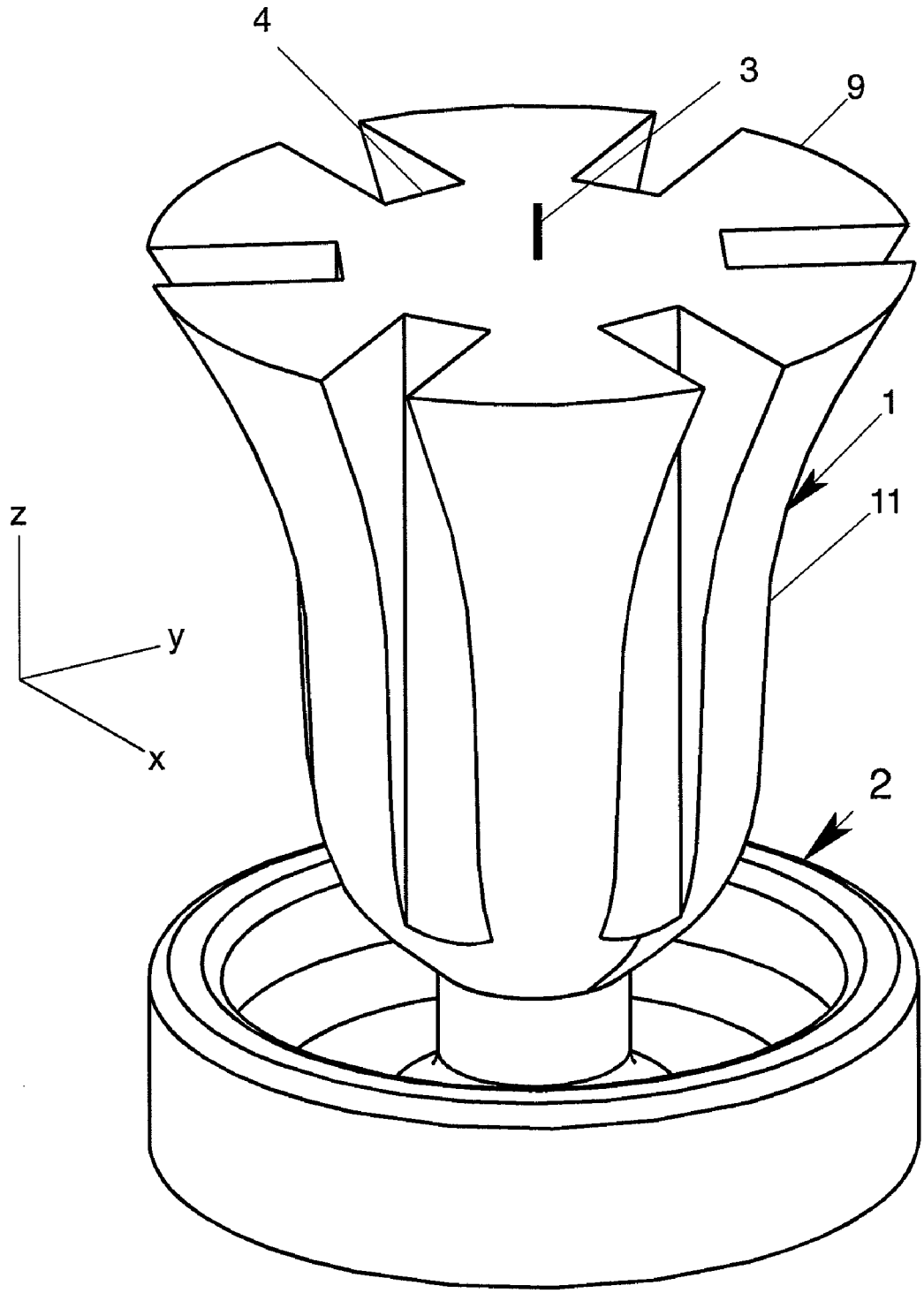
FIG. 8 is a trimetric view of a candle configuration that is round on top and non-linear along the tapered sides.

The shape of the candle body (1) shown in FIG. 1 is illustrated as a round cross-sectional shape (i.e. a cross-sectional view from the top of the candle body appears round) with a linearly tapered shape (e.g., a linearly tapered funnel of substantially circular shape) along the length of the candle body (1). However, any other appropriate cross-sectional shape may be employed, including but not limited to a square, a triangle or any other geometric shape as long as it has a tapered portion (11) along the length of the candle body (1), i.e., where the top portion of the candle has a larger effective diameter (or width) with respect to the bottom portion of the candle, with substantially vertical grooves (4) separating the outside surface into segments forming petals (9). Additional examples of possible candle configurations are shown and described with respect to FIG. 6, FIG. 7, and FIG. 8, but are not limited to these illustrative shapes. FIG. 8 illustrates one example of a non-linearly shaped taper along the exterior surface of the candle body (1). The tapered design will still facilitate separation of the petals (9) from the interior portion (or inner core) of the candle as long as the top portion of the candle (13) is larger than the bottom portion (12).

Figure 2:
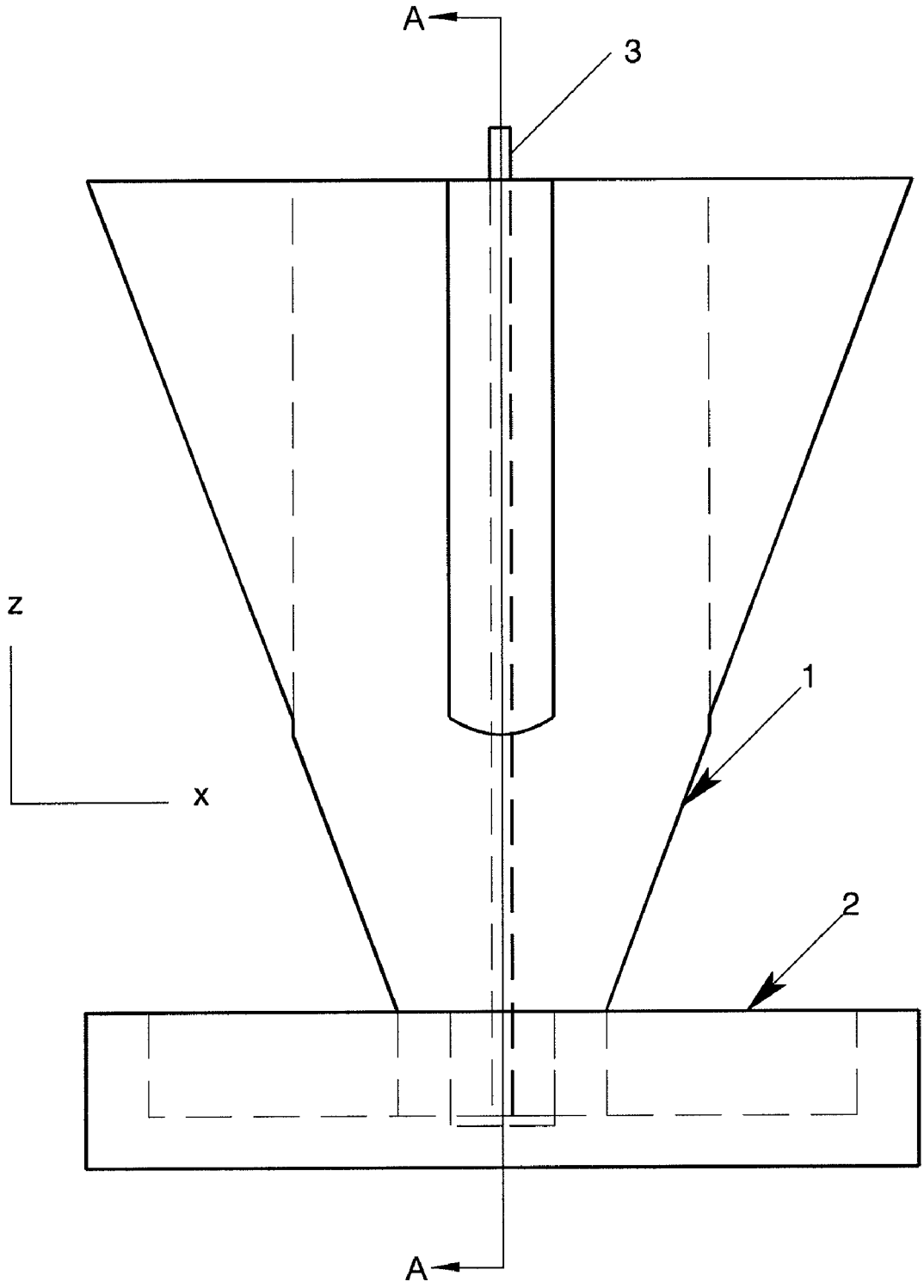
FIG. 2 shows a side view of the assembled candle body and candle base from FIG. 1.
Figure 3:
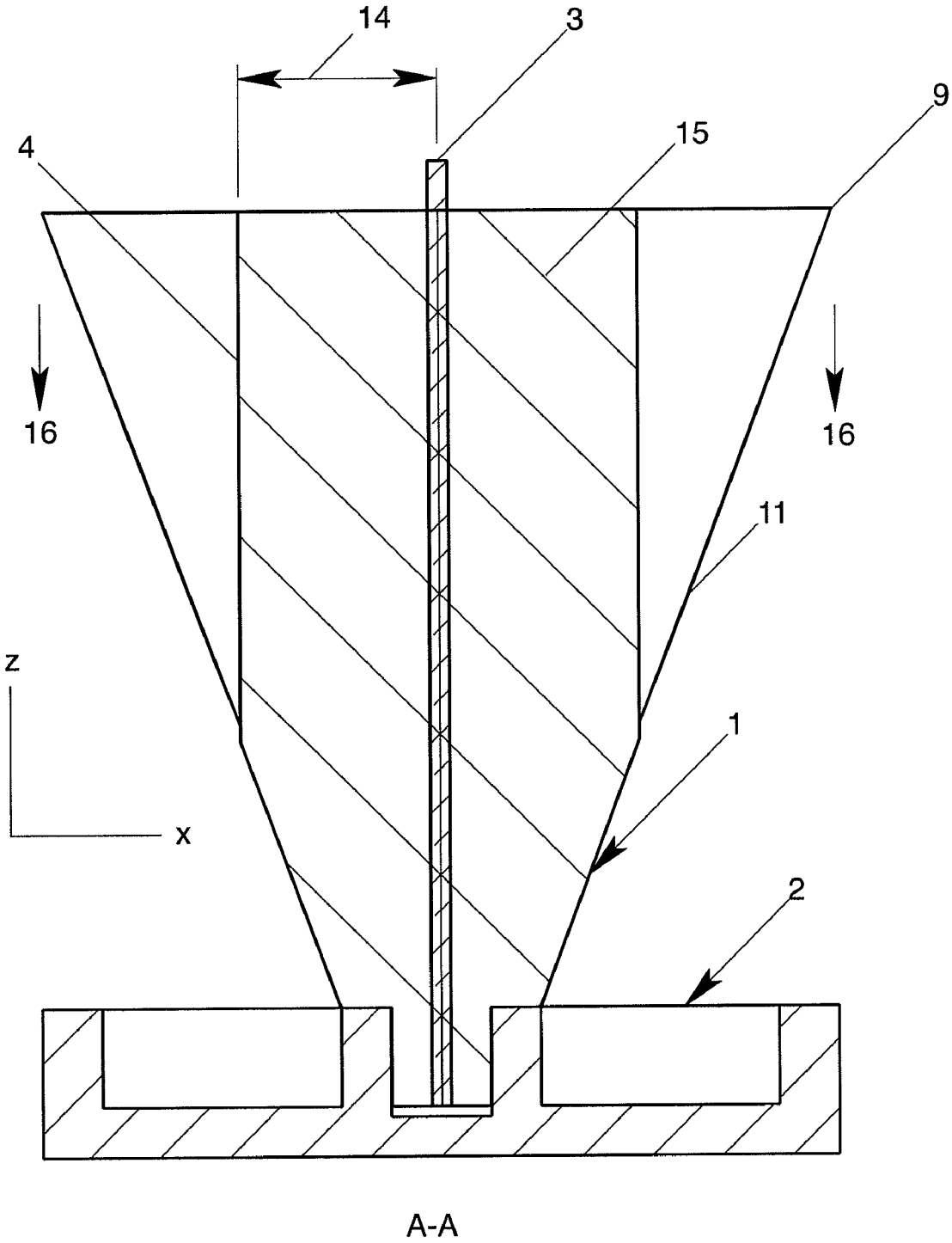
FIG. 3 illustrates a cross-sectional view (A-A) of the assembled candle body and candle base from FIG. 2, prior to burning.
Figure 4:
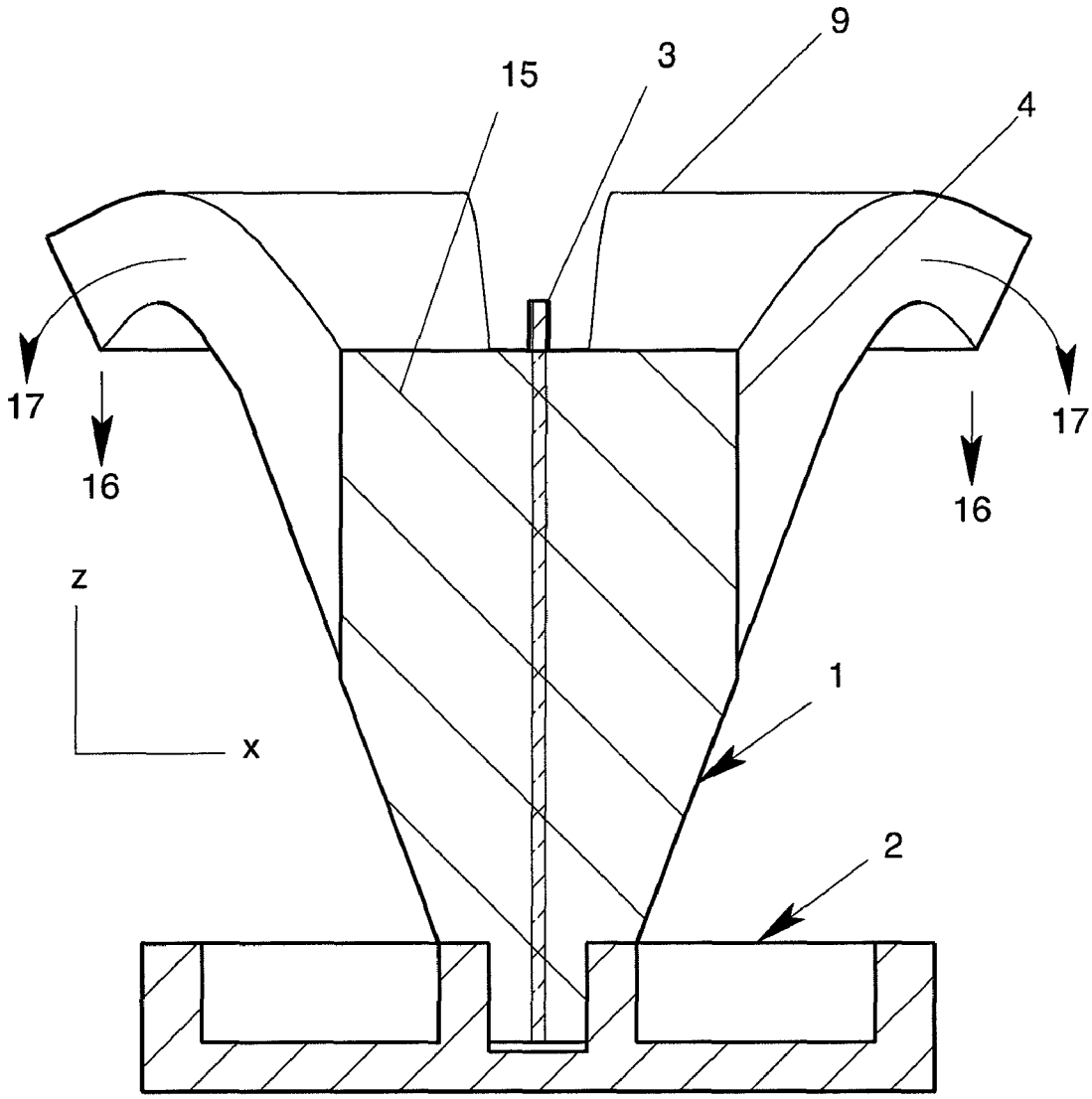
FIG. 4 illustrates another cross-sectional view (A-A) of the assembled candle body and candle base from FIG. 2, after the candle body has been partially burned.

FIG. 2 shows a side view of the assembled candle body (1) and candle base (2) from FIG. 1. FIG. 3 illustrates a cross-sectional view (A-A) of the assembled candle body (1) and candle base (2) from FIG. 2, prior to burning. FIG. 4 illustrates another cross-sectional view (A-A) of the assembled candle body (1) and candle base (2) from FIG. 2, after the candle body (1) has been partially burned. This cross section is taken in a spot where the progressive burning of candle body (1) can show the blooming (movement) of the petals (9) in a downward direction (e.g., along longitudinal axis z towards the base in plane x-y), which simulates the blooming or opening up of the petals of a flower.

Figure 5:
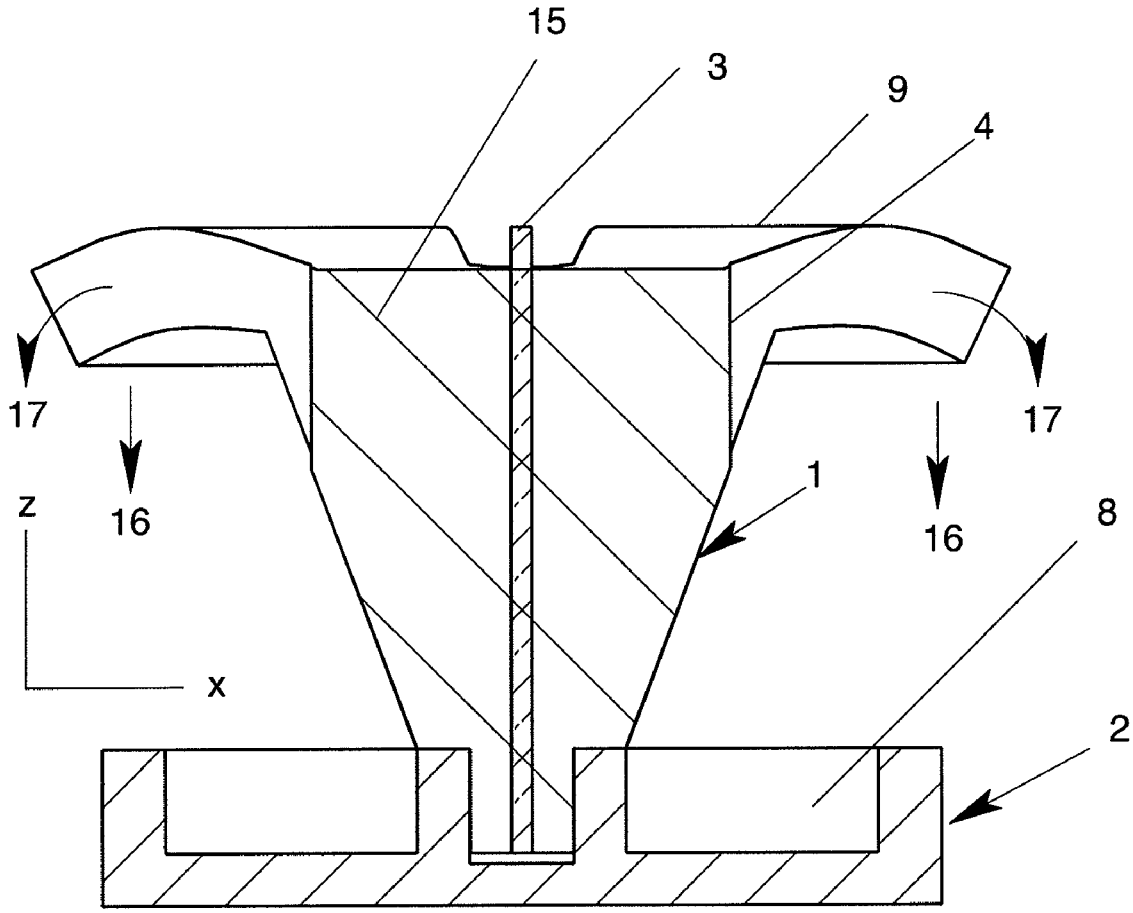
FIG. 5 illustrates yet another cross-sectional view (A-A) of the assembled candle body and candle base from FIG. 4, after additional burning and further movement of the petals in a substantially downward direction.

Each petal (9) is forced to support its own weight due to the vertical grooves (4) that separates them. The vertical grooves (4) are configured to intentionally weaken the exterior structural integrity of the candle body (1) along the longitudinal axis (z) to promote a predictable separation of the petals (9) during burning. The candle body (1) burns downward along the longitudinal axis (z) melting, burning and softening the surrounding wax. The softening of the wax undermines the support of the petals (9) by the interior core (15) of the candle body (1). A slow downward movement (relative to the longitudinal axis) of the petals (9) is promoted by the grooves (4) during the burning process. This downward movement is due to the effect of gravity pulling downward on the petals (9) as promoted by the intentionally degraded structural strength, which would be required to support the petals (9) to counter act the gravitational force (16). The petals (9) peel outward (17) with respect to the base (away from the core in an angular fashion) and downward from its original position. As illustrated in FIG. 4, the petals (9) continue to advance outward and/or downward as more burning occurs and more melting of the interior core (15) of the candle body (1) is burned. FIG. 5 illustrates yet another cross-sectional view (A-A) of the assembled candle body (1) and candle base (2) of FIG. 4, after additional burning and further movement of petals (9) in a substantially downward direction along the longitudinal axis (z).

The downward movement of the petals during burning is facilitated in part by the depth of grooves (4) relative to the Burn Radius (14) of the candle body (1). The Burn Radius is the radial distance from the wick across the body of the candle, at which point the wax from the body of the candle (1) transitions from a liquid to a solid about a top surface of the candle (13). An example Burn Radius is illustrated as radial distance (14) in FIG. 3. It should be noted that the candle burns for a short time interval to establish the radial distance from the wick (3). Once this radial distance has been established for a particular wick with a particular wax, the same wick and wax can be used to design any number of shapes.

The following table gives example burn radii for a small sample of wax and wick combinations. The table is not exhaustive and many other burn radii are contemplated for other wax and wick combinations. The below identified waxes and wicks are commercially available from Lone Star Candle Supply, Inc of Keller, Tex.

| Wick | Wax | Burn Radius |
|---|---|---|
| 44-20-18 | IGI-1343 melts @138° F. | 13/16" or 0.8125" |
| 44-32-18 | IGI-1343 melts @138° F. | 15/16" or 0.9375" |
| 60-44-18 | IGI-1343 melts @138° F. | 1 3/16" or 1.1875" |
| (3) Wicks 60-44-18 | IGI-1343 melts @138° F. | 1 5/8" or 1.625" |
| 44-20-18 | IGI-4794 melts @ 128° F. | 7/8" or 0.875" |
| 44-32-18 | IGI-4794 melts @ 128° F. | 1" |
| 60-44-18 | IGI-4794 melts @ 128° F. | 1 1/4" or 1.25" |

The point where the petals (9) begin to separate from the body of the candle (1) can be referred to as the Bloom Point. This location on the candle body (1) may be different for every design. The following design variables will determine the Bloom Point for a candle.

- Wick Size—The size (e.g. thickness) of the wick varies amount of heat radiated.
- Wick Material—The type of material used for the wick varies the heat radius and burn rate.
- Wax Type—different types of waxes melt at different temperatures.
- Groove Width (4)—the wider the groove the less wax that needs to be melted and softened.
- Groove Depth—the deeper the groove the smaller the requisite burn radius before the petals begin to descend.
- Quantity of grooves (4)—the more vertical grooves (4) the less wax required to melt prior to blooming
- Petal Width or Spacing between adjacent grooves the wider the petal, the more mass each petal possesses, and therefore the amount of melting required before the petal begins to advance changes.
- Taper (11)—the greater the difference in size from the top of the candle to the bottom (12) the faster the candle will begin to bloom after burning commences
- Surface area of (13)—The larger the top part of the candle at surface (13), the stronger the petals (9) will be due to the larger volume of wax to be melted before structural integrity is compromised allowing petals (9) movement.

The candle body (1) and the candle base (2) can be made from any wax or wax like substance that can be cast around a wick into a solid rigid structure that is free standing after being removed from a mold. The wax like substance should be able to melt and leach into the wick (3) so that the wax like substance can burn in a slow controlled manner. Examples materials include, but are not limited to IGI-1343, IGI-4794, IGI-4625. The identified waxes are petroleum based waxes that are commercially available from Lone Star Candle Supply, Inc of Keller, Tex. It is further understood that other non-petroleum based waxes may also be used, such as bees wax, soy based wax, etc.

In some examples, the candle body (1) and candle base (2) are comprised of the same type of wax material, while in other examples the candle body (1) and candle base (2) are comprised of different types of wax materials. The color associated with the wax material can either be a single uniform color, or different colors that are mixed together in a desired fashion (e.g., segmented portions of mixed colors, swirled mixes of colors, etc.). In some examples it may be desirable to mix a variety of wax materials together so that, for example, the rate at which the petals (9) advance can vary based on the type of wax material (i.e., controlling the rate of blooming).

Conventional candles have typically burned in a relatively uncontrolled fashion, where the shape of the candle after burning is a distortion of the original shape. In a typical pillar style candle, wax drips down the sides of the candle during burning in a relatively uncontrolled way. The presently disclosed candle apparatuses are specifically designed to transform the geometric shape of the candle during the burning process in a controlled manner, where the presented geometric shape progressively changes into a flowering shape with the movement of the petals (9). As the petals (9) bloom away from the body of the candle, the appearance of the candle is transformed into a new and aesthetically pleasing appearance in a relatively controlled way.

Although the invention has been described herein by way of exemplary embodiments, variations in the structures and methods described herein may be made without departing from the spirit and scope of the invention. For example, the positioning of the various portions of the candles may be varied. Individual component shapes for the candle, such as the shape of the petals, the shape of the base, the shape of the body of the candle, may be substituted as understood to one of skill in the art having read the present disclosure. Since many embodiments of the invention can be made without departing from the spirit and scope of the invention, the invention resides in the claims hereinafter appended.

I claim:

1. A candle apparatus that is arranged for placement in a candle base that is placed upon a flat surface, wherein the candle apparatus is arranged to transform between different appearances as the candle apparatus burns such that the candle apparatus transforms similar to blooming petals of a flower, the candle apparatus comprising:

a candle body having a top portion, a bottom portion, an outer surface, and an inner core, wherein the candle body is formed from a wax substance, wherein the top portion has a first surface area, wherein the bottom portion has a second surface area that is smaller than the first surface area, wherein the inner core extends along a longitudinal axis that extends from the top portion to the bottom portion, wherein the outer surface of the candle body extends from the top portion to the bottom portion along the longitudinal axis according to a tapered profile, wherein the outer surface is segmented into two or more segment portions that are separated by grooves having lengths that extend vertically from the top portion towards the bottom portion along the longitudinal axis, wherein a depth associated with the grooves extends from an edge of the inner core to the outer surface of the candle body, wherein the candle body is adapted for coupling to the candle base such that the candle body is supported in a substantially vertical orientation when coupled to the base and placed upon the flat surface, wherein the longitudinal axis is perpendicular to a plane associated with the flat surface such that the flat surface of the plane and the longitudinal axis form an orthogonal set with respect to one another;

a candle wick that extends along the longitudinal axis within the inner core of the candle body; and wherein the inner core directly surrounds the candle wick, and wherein the candle body formed by the inner core and the segment portions is an integral cast-molded part, wherein the segment portions have vertical lengths, wherein inner portions of the segment portions are connected to the inner core along a majority of the vertical lengths of the segment portions prior to burning the candle apparatus, wherein the candle includes a burn radius surrounding the wick and wherein the depth associated with the grooves is sufficiently deep to extend inwardly from the outer surface of the candle body to at least the burn radius of the candle, and wherein the depths of the grooves relative to the burn radius and a taper angle of the tapered profile cause the segment portions of the candle body to gradually separate from the inner core of the candle body by plastically deforming radially away and downwardly from the inner core as the candle body burns such that the segment portions transform during burning with an appearance that is similar to the blooming petals of the flower.

2. The candle apparatus of claim 1, wherein a cross-sectional shape of the first surface area corresponds to a round region of the top portion of the candle body having a first diameter, wherein the a cross-sectional shape of the second surface area corresponds to a round region of the bottom portion of the candle body having a second diameter, and wherein the first diameter is greater than the second diameter.

3. The candle apparatus of claim 1, wherein a cross-sectional shape of the first surface area corresponds to a square region of the top portion of the candle body having a first width, wherein a cross-sectional shape of the second surface area corresponds to a square region of the bottom portion of the candle body having a second width, and wherein the first width is greater than the second width.

4. The candle apparatus of claim 1, wherein a cross-sectional shape of the first and second surface areas corresponds to at least one member of the group comprising a geometric shape, wherein the geometric shape corresponds to a round shape, an oval shape, or an n-sided shape, where n is an integer greater than two.

5. The candle apparatus of claim 1, wherein a shape for the tapered profile corresponds to at least one member of the group comprising a linearly shaped profile, a non-linearly shaped profile, a piece-wise linearly shaped profile, a piece-wise non-linearly shaped profile, or any combination thereof.

6. The candle apparatus of claim 1, wherein a shape for the grooves corresponds to at least one member of the group comprising a linear shape, a curved shape, a non-linear shape, a piece-wise linear shape, a piece-wise non-linear shape, a zig-zag shape, an S-shaped groove, or any combination thereof.

7. The candle apparatus of claim 1, wherein a width associated with the grooves is either uniform or varying along with a length of the candle body.

8. The candle apparatus of claim 1, wherein the depth associated with the grooves at a horizontal cross-section of the candle body correspond to at least one member of the group comprising: a constant depth, a linearly varying depth, a non-linearly varying depth, a piece-wise linearly varying depth, a piece-wise non-linearly varying depth, or any combination thereof.

9. The candle apparatus of claim 1, the wax substance comprising a wax material that has one or more colors associated therewith.

10. The candle apparatus of claim 1, the candle wick comprising two or more wick materials that are dispersed about a surface of the top portion that is associated with the inner core.

11. The candle apparatus of claim 1, wherein the candle body is adapted for coupling to the candle base at an interlocking interface, wherein the bottom portion of the candle body includes a portion of the interlocking interface corresponding to either a male interface element or a female interface element.

12. The candle apparatus of claim 1, wherein the bottom portion of the candle body corresponds to a male interface element corresponds to one of a round peg, an oval peg, or an n-sided peg, where n is an integer greater than two.

13. A candle apparatus that is arranged for placement upon a flat surface, wherein the candle apparatus is arranged to transform between different appearances as the candle apparatus burns such that the candle apparatus transforms similar to blooming petals of a flower, the candle apparatus comprising:

a candle body having a top portion, a bottom portion, an outer surface, and an inner core, wherein the candle body is formed from a wax substance, wherein the top portion has a first surface area, wherein the bottom portion has a second surface area that is smaller than the first surface area, wherein the inner core extends along a longitudinal axis that extends from the top portion to the bottom portion, wherein the outer surface of the candle body extends from the top portion to the bottom portion along the longitudinal axis according to a tapered profile, wherein the outer surface is segmented into two or more segment portions that are separated by grooves that extend from the top portion towards the bottom portion along the longitudinal axis, wherein a depth associated with the grooves extends from an edge of the inner core to the outer surface of the candle body, wherein the candle body has a length that extends from the top portion to the bottom portion of the candle body, and wherein the grooves extend along a majority of the length of the candle body;

a candle base having a middle portion that is coupled to the bottom portion of the candle body, wherein the candle body is supported in a substantially vertical orientation when the candle base is placed on the flat surface, wherein the longitudinal axis is perpendicular to a plane associated with the flat surface such that the flat surface of the plane and the longitudinal axis form an orthogonal set with respect to one another; and a candle wick that extends along the longitudinal axis within the inner core of the candle body, wherein wax material from the melting candle body is collected in a trough region of the candle base, wherein the candle includes a burn radius surrounding the wick, wherein the depth associated with the grooves is sufficiently deep to extend inwardly from the outer surface of the candle body to at least the burn radius of the candle, wherein the segment portions have vertical lengths, wherein inner portions of the segment portions are connected to the inner core along a majority of the vertical lengths of the segment portions prior to burning the candle apparatus, and wherein the depths of the grooves relative to the burn radius and a degree of taper of the tapered profile cause the segment portions of the candle body to gradually separate from the inner core of the candle body by plastically deforming radially away and downwardly from the inner core as the candle body burns such that the segment portions transform during burning with an appearance that is similar to the blooming petals of the flower.

14. The candle apparatus of claim 13, wherein the candle base is comprised of another wax substance that is either the same as the wax substance of the candle body or different from the wax substance of the candle body.

15. The candle apparatus of claim 13, wherein the candle base has a shape corresponding to one of a round shape, an oval shape, or an n-sided shape, where n is an integer greater than two.

16. The candle apparatus of claim 13, wherein the candle base is integrally formed with the candle body such that the candle base is formed at the bottom portion of the candle body, wherein the candle base has a greater surface area than the bottom portion of the candle body.

17. The candle apparatus of claim 13, wherein the candle base is adapted for coupling to the candle body at an interface, wherein the bottom portion of the candle body includes one portion of the interface and the middle portion of the candle base includes another portion of the interface, wherein the interface includes a male interface element and a female interface element adapted for interlocking engagement with the male interface element.

18. The candle apparatus of claim 17, wherein the male interface element corresponds to one member of the group comprising: a round peg, an oval peg, or an n-sided peg, where n is an integer greater than two.

19. The candle apparatus of claim 13, wherein the candle base is comprised of one material from a group consisting of glass, ceramic, plastic and resin.

20. The candle apparatus of claim 13, wherein the candle base further comprises an inner wall formed about the middle portion and an outer wall formed about a periphery of the candle base and wherein the trough region is formed between the inner wall and the outer wall.

21. The candle apparatus of claim 20, wherein the outer wall of the candle base has a shape corresponding to one of a circular shape, an oval shape, or an n-sided shape, wherein n is greater than two.

22. The candle apparatus of claim 20, wherein one of the outer wall and the inner wall of the candle base has a cross-sectional profile that corresponds to one of a vertical wall, a linearly sloped wall, a non-linearly sloped wall, a piece-wise linearly sloped wall, a piece-wise non-linearly sloped wall, or any combination thereof.

23. A candle apparatus that is arranged for placement upon a flat surface, wherein the candle apparatus is arranged to transform between different appearances as the candle apparatus burns such that the candle apparatus transforms similar to blooming petals of a flower, the candle apparatus comprising:

an axisymmetric candle body having a top portion, a bottom portion, an outer surface arrangement, and an inner core, wherein the candle body is formed from a first wax substance, wherein the top portion has a first surface area, wherein the bottom portion has a second surface area that is smaller than the first surface area, wherein the inner core extends along a longitudinal axis that extends from the top portion to the bottom portion, wherein the outer surface arrangement of the candle body extends from the top portion to the bottom portion along the longitudinal axis according to a tapered profile, wherein the outer surface arrangement defining the tapered profile also extends along a curvature revolved about the longitudinal axis of the candle body, wherein the tapered profile has a length that extends along the longitudinal axis, wherein the outer surface arrangement is segmented into two or more segment portions that are separated by grooves that extend from the top portion towards the bottom portion along the longitudinal axis, wherein a depth associated with the grooves extends from an edge of the inner core to the outer surface arrangement of the candle body, and wherein the grooves extend along a majority of the length of the tapered profile;

a candle base having an outer wall and an inner wall formed about a middle portion thereof, wherein the middle portion is coupled to the bottom portion of the candle body at an interface, wherein the candle base is formed from a second wax substance, wherein the candle base has a greater surface area than the bottom portion of the candle body such that the candle body is supported in a substantially vertical orientation when the candle base is placed on the flat surface, wherein the longitudinal axis is perpendicular to a plane associated with the flat surface such that the flat surface of the plane and the longitudinal axis form an orthogonal set with respect to one another, wherein a trough region is formed between the outer wall and the inner wall; and a candle wick that extends along the longitudinal axis within the inner core of the candle body, wherein the candle wick and the first wax substance together have a burn radius surrounding the wick that determines a bloom point where the segmented portions of the candle body transform during burning with an appearance that is similar to the blooming petals of the flower, whereby wax material from the melting candle body is collected in the trough region of the candle base, wherein the depth associated with the grooves is sufficiently deep to extend inwardly from the outer surface of the candle body to at least the burn radius of the candle, wherein the segment portions have vertical lengths, wherein inner portions of the segment portions are connected to the inner core along a majority of the vertical lengths of the segment portions prior to burning the candle apparatus, and wherein the depths of the grooves relative to the burn radius and a degree of taper of the tapered profile cause the segment portions of the candle body to gradually separate from the inner core of the candle body by plastically deforming radially away and downwardly from the inner core as the candle body burns.

24. A candle comprising:

a candle body defining a length that extends downwardly from a wick lighting end of the candle body, the candle body defining a central longitudinal axis that extends along the length of the candle body, the candle body including an outer surface arrangement that faces outwardly from the longitudinal axis and defines an exterior boundary of the candle body, the exterior boundary of the candle body having a tapered configuration that converges toward the central longitudinal axis as the tapered configuration extends downwardly along the length of the candle body, the tapered configuration extending along a majority of the length of the candle body, the candle body also defining a plurality of exterior grooves that extend downwardly along a majority of the length of the candle body through at least a portion of the tapered configuration of the candle body, the exterior grooves having outer open sides positioned at the exterior boundary and inner closed sides spaced inwardly from the outer open sides, the outer open sides and the inner closed sides of the exterior grooves extending along a majority of the length of the candle body, the exterior grooves defining depths that extend from the outer open sides to the inner closed sides, the exterior grooves dividing the candle body into a plurality of segments spaced circumferentially about the central longitudinal axis, the segments having lengths that extend downwardly along a majority of the length of the candle body, the tapered configuration of the exterior boundary of the candle body also converging toward the inner closed sides of the exterior grooves as the tapered configuration extends downwardly along the length of the candle body thereby causing the depths of the exterior grooves to decrease as the exterior grooves extend downwardly along the length of the candle body; and a wick that extends from the wick lighting end of the candle body downwardly through the candle body, the candle defining a burn radius surrounding the wick, wherein the depths of the exterior grooves are sufficiently deep to extend inwardly from the exterior boundary to at least the burn radius of the candle, and wherein the depths of the grooves relative to the burn radius and a degree of taper of the tapered configuration of the candle body cause the segments to transform by plastically deforming radially away and downwardly from an inner core of the candle body as the candle burns to provide an appearance that is similar to blooming petals of a flower wherein prior to burning of the candle inner portions of the segments are connected to the inner core at locations adjacent to top ends of the segments.

25. The candle of claim 24, wherein the inner closed sides of the exterior grooves extend vertically when the candle body is oriented with the central longitudinal axis extending vertically.

26. The candle of claim 25, wherein the exterior grooves include opposing surfaces that extend from the inner closed sides to the outer open sides of the exterior grooves and wherein the opposing surfaces extend vertically when the candle body is oriented with the central longitudinal axis extending vertically.

27. The candle of claim 24, wherein the depths extend in radial directions relative to the central longitudinal axis of the candle body.

28. A candle comprising:

a candle body defining a length that extends downwardly from a wick lighting end of the candle body, the candle body defining a central longitudinal axis that extends along the length, the candle body including an outer surface arrangement that faces outwardly from the central longitudinal axis and defines an exterior boundary of the candle body, the exterior boundary of the candle body having a tapered configuration that converges toward the central longitudinal axis as the tapered configuration extends downwardly along the length of the candle body, the tapered configuration extending along a majority of the length of the candle body, the candle body also defining a plurality of exterior grooves that extend downwardly along a majority of the length of the candle body through at least a portion of the tapered configuration, the exterior grooves having outer open sides and inner closed sides spaced inwardly from the outer open sides, the outer open sides and the inner closed sides of the exterior grooves extending along a majority of the length of the candle body, the exterior grooves defining depths that extend from the outer open sides to the inner closed sides, the inner closed sides being positioned at a core of the candle body, the exterior grooves dividing the candle body into a plurality of segments spaced circumferentially about the central longitudinal axis, the segments having inner portions integral with the core of the candle body and outer portions defined by the outer surface arrangement, the segments having lengths that extend downwardly along a majority of the length of the candle body, wherein the inner portions of the segments are integrally connected as a solid body with the core of the candle body along a majority of the length of each of the respective segments, and wherein the segments form flower petals that gradually open as the candle burns down the central longitudinal axis of the candle body; and a wick that extends from the wick lighting end of the candle body downwardly through the candle body, the candle defining a burn radius surrounding the wick, wherein the depths of the exterior grooves are sufficiently deep to extend inwardly from the exterior boundary to at least the burn radius of the candle, and wherein the depths of the grooves relative to the burn radius and a degree of taper of the tapered configuration of the candle body cause the segments to transform by plastically deforming radially away and downwardly from an inner core of the candle body as the candle burns to provide an appearance that is similar to blooming petals of a flower.

29. The candle of claim 28, wherein the candle body is axisymmetric.

30. The candle of claim 28, wherein the outer surface arrangement extends along a curvature revolved around the wick.

31. The candle of claim 28, wherein the inner portions of the segments are integral with the core of the candle body along substantially the entire length of each of the respective segments.

* * * * *